United States Patent [19]

Claeys et al.

[11] Patent Number: 4,708,660

[45] Date of Patent: Nov. 24, 1987

[54] CONNECTOR FOR ORTHOGONALLY MOUNTING CIRCUIT BOARDS

[75] Inventors: Richard J. Claeys, Bloomington; Ronald R. Denny, Brooklyn Center; Joseph D. Vaughan, Burnsville; Charles Eumurian, Mahtomedi, all of Minn.

[73] Assignee: Control Data Corporation, Minneapolis, Minn.

[21] Appl. No.: 877,311

[22] Filed: Jun. 23, 1986

[51] Int. Cl.[4] ..... H01R 23/70

[52] U.S. Cl. ..... 439/65; 439/79; 439/248; 439/284; 439/533

[58] Field of Search ..... 339/17 LM, 17 LC, 17 M, 339/64 R, 64 M, 65, 66 M, 47 R, 49 R; 361/412, 413, 416

[56] References Cited

U.S. PATENT DOCUMENTS

| | | | |
|---|---|---|---|
| 2,124,207 | 7/1938 | Neesen | 339/49 R |
| 3,086,188 | 4/1963 | Ross | 339/49 R |

FOREIGN PATENT DOCUMENTS

| | | | |
|---|---|---|---|
| 630921 | 11/1961 | Canada | 339/17 LM |
| 295583 | 5/1965 | Netherlands | 339/49 R |

*Primary Examiner*—Neil Abrams

*Attorney, Agent, or Firm*—Robert M. Angus; Joseph A. Genovese; Frederick W. Niebuhr

[57] ABSTRACT

A connecting device is disclosed for electrically and mechanically linking multiple circuit boards arranged in two perpendicular stacks. The connecting device includes two identical connectors, each with a plurality of outwardly extended electrical socket contacts, and a pair of opposite, electrically insulative shoulders projected outwardly beyond the socket contacts. Electrical pin contacts are recessed into the shoulders. The pair of connectors can be engaged when in facing relation, with one of them rotated 90° relative to the other. As the connectors are moved toward engagement, each shoulder of each connector enters into a nesting relation between the opposed shoulders of the other connector, pre-aligning the opposed pin and socket contacts. The shoulders have inclined edges at their outer faces, to assist in capturing their associated opposed shoulders and guide them, in a self-aligning manner, into the nesting relation. The connectors require a 90° angular offset for their engagement, and thus facilitate interconnection of circuit boards in orthogonal stacks.

22 Claims, 10 Drawing Figures

CONNECTOR FOR ORTHOGONALLY MOUNTING CIRCUIT BOARDS

BACKGROUND OF THE INVENTION

The present invention relates to connectors for electrically and mechanically linking circuit boards, and to assemblies of multiple interconnected circuit boards.

The use of circuit boards of memory, logic and other circuitry is well known in the data processing field. The interconnection of multiple circuit boards is particularly advantageous in connection with large scale computers, where space for electrical circuits is at a premium, and the shortest possible electrical paths between and within discrete circuits are desired.

One particularly useful interconnection of multiple circuit boards is an orthogonal mounting of a "horizontal" stack of circuit boards to an adjacent "vertical" stack. This arrangement occupies a minimum of space, and permits direct contact between each board of one of the stacks with every board of the other stack. Further, each electrical connection is through a short conductive path, significantly reducing travel time for electric signals for a corresponding reduction in time to perform various operations.

Orthogonal arrangements, however, require special devices for effecting electrical and mechanical connection between the multiple circuit boards. For example, U.S. Pat. No. 4,472,765 to Hughes granted Sept. 18, 1984 shows a row of zero insertion force electrical connectors 7 connected to a row of perpendicular zero insertion force connections 17, through a mother board 4. Pins from connectors 7 and 17 are inserted through openings in the mother board, with certain pins from each connector pressed into holes in diamond-shaped conductive areas 40, thus to electrically link various connectors. U.S. Pat. No. 3,660,803 to Cooney granted May 2, 1972 shows a connector 20 with a longitudinal slot that supports a circuit card 11. On the opposite side, connector 20 has contact elements 70 and 90 for connection with a memory stack 60 normal to circuit cards 11.

Joining multiple boards, whether or not orthogonally, involves further problems due to the multiplicity of electrical pin contacts and mating socket contacts involved in the connection. Any misalignment can cause failure to accomplish electrical contact, and can damage the pin contacts. One approach to this problem has been the zero force connector mentioned in Hughes, yet such connectors are relatively expensive.

An individual connector between parallel circuit boards is shown in U.S. Pat. No. 4,482,937 to Berg granted Nov. 13, 1984. Pairs of substantially identical, oppositely oriented housing members 30 and 90 are positioned between parallel circuit boards 5 and 65. Each of the housings has a projection 36 and an associated alignment cavity 37, with apertures 32 and 34 for sockets and pins, respectively. On a much larger scale, a four pole coupler for a dynamic loudspeaker is described in U.S. Pat. No. 2,124,207 to Neesen granted July 19, 1938. Opposed plug and socket members have circular contact faces divided into alternating pie-shaped extended and retracted surfaces. Female contacts are mounted in the extended surfaces, while male contacts extend from the recessed surfaces. The arrangement protects the male contacts and ensures proper connection.

The plug and socket disclosed in the Neesen Patent are complementary, yet differ in structure. Consequently, such plug/socket design, when applied to the micro scale of circuit board interconnection, raises three problems:

(1) The potential for error due to mounting of a socket where the intention was to mount a plug;

(2) The lack of flexibility resulting from having to choose either the plug or socket; and (3) The need to keep inventories of both plugs and sockets as spare parts.

Further, the Neesen design fails to avoid the alignment and insertion force problems caused by multiple connections.

It therefore is an object of the present invention to provide a connector structure simple in design and adapted to facilitate multiple circuit connections by pre-aligning mating pin and socket contacts.

Another object of the invention is to provide a single connector structure used as both a plug portion and socket portion of a connecting device.

Another object of the invention is to provide a single connector structure mounted to all of the circuit boards in an orthogonal mounting scheme, and which ensures orthogonal mounting.

Yet another object of the invention is to provide an assembly of orthogonally mounted circuit boards, based on a single type of connector, with each connector mounted in an identical orientation with respect to its associated one of the circuit boards.

SUMMARY OF THE INVENTION

To achieve these and other objects, there is provided a device for making multiple electrical connections. The device includes complementary first and second connectors, each connector having an electrically insulative connector body, a plurality of spaced apart electrical first contacts mounted in the connector body and extended away from the body, a plurality of electrically insulative shoulders projected away from the body beyond the free ends of the first contacts, and a plurality of spaced apart electric complementary contacts recessed into the shoulders and open to outwardly facing should surfaces of the shoulders. The first and second connectors are adapted for interlocking mechanical and electrical engagement, with each shoulder of each connector in a nesting relation between a pair of adjacent shoulders of the other connector, with the shoulder surfaces of each conector facing the body of the other connector, and with the first contacts of each connector engaged with the complementary contacts of the other connector. At least one inclined edge surface is formed in each shoulder next to its shoulder surface, whereby each of the pairs of shoulders, during longitudinal movement of the connectors toward their locking engagement, capture their associated shoulder whenever it is at least approximately aligned for the nesting relation, and guide the associated shoulder transversely into alignment for the nesting relation responsive to the longitudinal movement.

Preferably, the shoulder surfaces of each connector diverge linearly and transversely away from a central portion of the body, to form an interfacing surface consisting of the shoulder surfaces alternating with sectors of the side surface from which the shoulders project. One convenient arrangement is for each connector to have two opposite shoulders. Its interfacing surface then is comprised of the two associated shoulder surfaces and two opposite sectors of the associated side surface, with the shoulder surfaces and sectors each spanning an arc of 90°.

When so constructed, opposed connectors are substantially identical, and can be mated simply by rotating one of them 90°. With one part serving as both the plug and socket of a connecting device, use of the connector is simplified, flexibility is enhanced, and necessary spare part inventory is reduced.

The shoulders of opposed complementary connectors encounter each other and become aligned in their nesting relation well before they contact the opposed first contacts, thus to ensure proper alignment and protect the contacts. With the inclined edge surfaces, the shoulders tend to position themselves for nesting as the opposed connectors are moved toward one another. As a result, the connectors are self-aligning, a particular advantage when multiple connectors are mounted to opposed edges of circuit boards to be connected with one another.

Thus, another aspect of the present invention is an assembly of mechanically and electrically interconnected circuit boards. The assembly includes a first stack or row of substantially parallel and aligned first circuit boards. A first plurality of substantially identical connectors are supported alongn an interface edge of each first circuit board, with each connector in a select orientation with respect to its associated first circuit board. The assembly further includes a second row of substantially parallel and aligned second circuit boards. A second plurality of the connectors is supported along an interface edge of each second circuit board, and each connector is in the select orientation with respect to its associated second circuit board. Each of the connectors along the interfacing edge of each first circuit board is in an interlocking engagement with one of the connectors associated with each of the second circuit boards. This maintains the first and second rows in an edge facing relation to one another.

A plurality of elongate separator members can be provided, one for supporting connectors with respect to each of the first and second circuit boards. Each separator has an elongate base running along its associated interfacing edge, and a plurality of othogonal legs extending away from the circuit board. One of the connectors is then supported between each pair of adjacent legs. Preferably the distance between adjacent legs is greater than the connector width, to permit limited connector movement with respect to the separator member.

A support means can be provided between the first and second rows of circuits boards, to form an interface plane between the rows. A preferred form of support means is a grid with a plurality of elongate spaced apart first members perpendicular to the circuit boards in the first row, and a plurality of elongate spaced apart second members orthogonal to the circuit boards in the second row. The first and second support members are connected to each other at contiguous portions of their inside surfaces, and the inside surfaces define a support plane. The opposing first and second rows are supported with respect to the plane on opposite sides of it.

Yet another aspect of the present invention is a process for conecting first and second rows of circuit boards orthogonally with respect to one another. The method includes the steps of:

(a) Mounting a plurality of substantially identical connectors along an interface edge of each of the first circuit boards, with each of the connectors in a select orientation with respect to its associated one of the first circuit boards;

(b) Mounting a second plurality of the connectors along an interfacing edge of each of a plurality of second circuit boards, with each connector in the same select orientation with respect to its associated one of the second circuit boards;

(c) Aligning the first and second rows of circuit boards orthogonally with respect to one another, with the interfacing edges of the first and second circuit boards facing each other, and with each of the contacts supported relative to each of the first circuit boards opposed to an associated one of the connectors supported relative to the second circuit boards; and (d) Moving the first and second rows of circuit boards towards each other, to move each connector and its opposed associated connector into an interlocking engagement.

Through use of the same connector on both the first and second circuit boards, and in the same selected orientation relative to its associated circuit board, the interconnecting process is simplified and chances for error significantly reduced. Also, when the assembly of itnerconnected circuit boards includes first and second rows angularly offset from one another, it is possible to interconnect each first circuit board with every one of the second circuit boards. Given the same connector and orientation, one of the second boards can be interchanged with one of the first circuit boards in a given assembly. When the connectors are supported for limited movement relative to their associated circuit board, they become self-aligning, to ensure a proper connection between the multiplicity of opposing male and female electrical contacts.

IN THE DRAWINGS

These and other features and advantages will become more apparent upon a reading of the following detailed description in view of the following drawings in which.

DETAILED DESCRIPTION OF THE PREFERRED EMBODIMENT

Turning now to the drawings, there is shown an assembly 16 of interconnected circuit cards or boards, including a first row or stack of horizontal cards 18, and a second stack consisting of vertical cards 20. The horizontal and vertical circuit boards are connected to each other through a back plane grid having an outer frame portion 22.

An orthogonal arrangement such as that shown is advantageous in a variety of applications, for example in large multiport memory systems, where memory can be located on the horizontal boards or cards, and ports provided on the vertical cards. Another application involves using the horizontal cards as adders, multipliers, and other "functional" cards, with control memory in the vertical stack. Regardless of the specific application, orthogonal mounting enables interconnection of each horizontal card with every vertical card, and vice versa. Further, the electrical path lengths are kept to a minimum.

The present arrangement interconnects a stack of thirty-four horizontal cards 18 with a stack of thirty-four vertical cards 20. However, it often is advisable to devote space for one circuit board to external I/O connections, and to reserve each center location for clock fan-out and other centralized functions.

Figure 2:
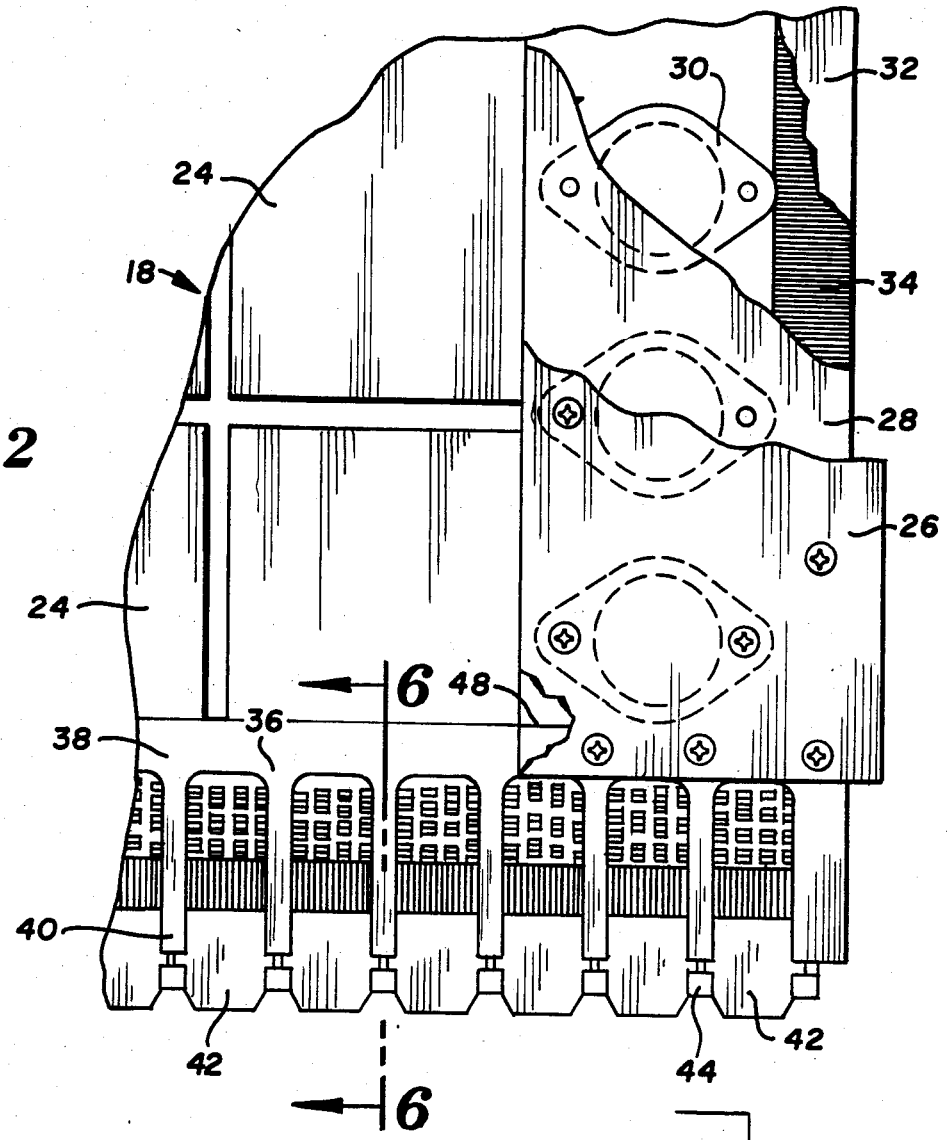
FIG. 2 is a top elevation of one of the circuit boards from the assembly in FIG. 1.

In FIG. 2, one of horizontal circuit boards 18 is removed from the assembly to more clearly show a plurality of logic chips 24 over the board's surface. Mounted along one edge of board 18 is a regulator printed circuit board 26 overlying an upper plate 28 which is part of a heat sink assembly. Mounted to the upper plate are a plurality of transistors, one of which is shown at 30. Each circuit board 18 is attached to a lower plate 32 which also is a heat sink, and a row of conductive vertical fins 34 stand perpendicularly between the upper and lower plates. The remaining horizontal circuit boards, and vertical circuit boards 20, are substantially identical in structure. The arrangement and number of logic chips, transistors, etc. may vary among the circuit boards.

Attached to circuit board 18 and running along an interfacing edge thereof, is an elongate separator 36. The separator includes an elongate base 38 running along the interface edge, and a plurality of perpendicular, spaced apart legs 40 extending away from circuit board 18. Supported along the separator are a plurality of electrical connectors 42, one between each adjacent pair of legs 40. A plurality of retaining caps 44, one mounted to the free end of each leg, secure connectors 42 with respect to legs 40. Screws 46 (FIG. 6) fasten the caps. An electrically insulative layer 48 runs between separator 36 and the interface edge of circuit board 18 along the width of circuit board 26.

Each of connectors 42 is mounted to the circuit board in the same orientation, i.e. with its flat top and bottom surfaces parallel to the major plane of the circuit board, and with its electrical contacts extended perpendicularly to the interface edge. A separator substantially identical to separator 36 is used to mount connectors 42 in the same select orientation with respect to the remaining horizontal circuit boards 18, and also to support connectors 42, again in the same orientation, with respect to each of the vertical circuit boards 20.

Figure 3:
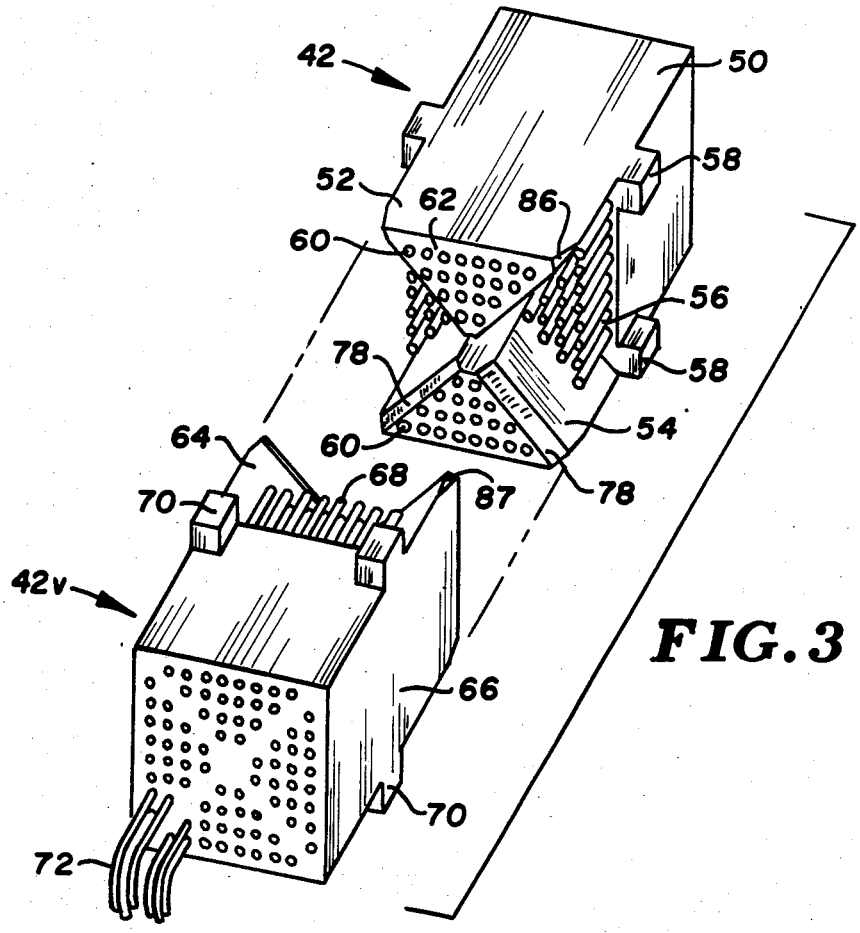
FIG. 3 is a perspective view of two connectors constructed in accordance with the present invention and used in the assembly of FIG. 1.

FIG. 3 shows two opposed connectors 42 and **42*v*. Connector 42*v* is substantially identical to connector 42, and designated 42*v* to illustrate its vertical orientation, i.e. that of a connector supported on one of vertical boards 20**.

Connector 42 has an electrically insulated body 50, cubic in shape. Projected longitudinally from one side of body 50 in a longitudinal direction, are a pair of opposite first and second shoulders 52 and 54. A plurality of electrical female or socket contacts 56 extend longitudinally from the same side of body 50, but only about half as far as the shoulders. Four ears 58, three of which are visible, extend horizontally and transversely from the body, and retain connector 42 with respect to separator 36 when engaged by their associated caps 44. A series of longitudinally extended complementary electrical pin or male contacts 60 are embedded in first shoulder 52, and open to a forwardly facing shoulder surface 62. A substantially identical series of electrical pin contacts 60 is embedded in second shoulder 54 and open to its shoulder surface.

Figure 6:
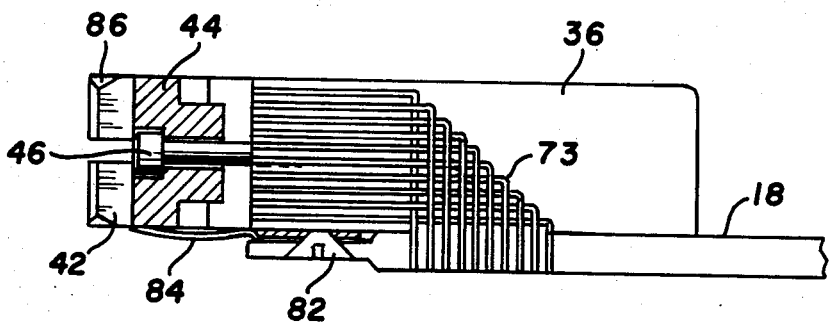
FIG. 6 is a sectional view taken along the line 6—6 in FIG. 2.

Opposed connector **42*v* includes first and second shoulders 64 and 66, socket contacts 68, pin contacts (not shown), and ears 70. A series of wires 72, one for each of the pin and socket contacts, extends from connector 42*v* opposite to the shoulders and pin contacts. While only a few wires 72 are shown, it is understood that one of these wires is provided for each of the pin and socket contacts, and that a similar series of wires extends from the rearward surface of connector 42. Substantially identical wires 73 extend from connector 42 (FIG. 6**).

Figure 4:
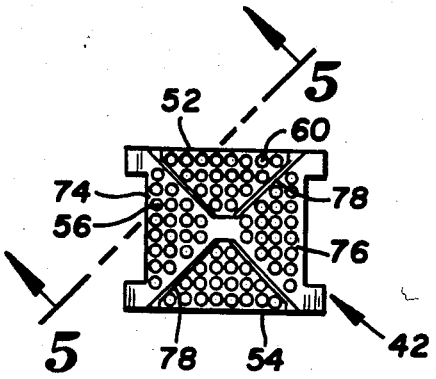
FIG. 4 is a front elevation of one of the connectors.

From the front elevation of FIG. 4, it is apparent that shoulders 52 and 54 have sides which diverge linearly and transversely from the connector center, forming substantially triangular shoulder surfaces. Consequently, an interfacing surface of connector 42 can be considered to consist of the two shoulder surfaces, and first and second sectors 74 and 76 of the recessed surface from which the shoulders project. Each shoulder surface, like each sector, includes twenty electrical contacts, for a total of eighty contacts in each connector 42.

When positioned as shown in FIG. 3, connectors 42 and **42*v* are aligned for longitudinal movement into an interlocking mechanical and electrical engagement, with each of shoulders 52 and 54 in a nesting relation between shoulders 64 and 66**, and vice versa. When the connectors are fully engaged, the shoulder surfaces of each are contiguous with the recessed surface sectors of the other, and the pin contacts of each are engaged with the socket contacts of the other. The connectors cannot be joined unless angularly offset 90° as shown. Alternative shoulder shapes could be selected to change the degree of offset, or eliminate it.

Given a few connectors relatively large in size, such interlocking is virtually trouble-free. Significant alignment problems arise, however, when multiple rows of connectors 42 and **42*v* must be interlocked simultaneously. The difficulties are exaggerated by the relatively small size of connectors 42 and 42*v*, each of which has an interfacing surface area of less than 0.3 square inches for its eighty contacts. A matrix of thirty-four horizontal boards 18 joined to thirty-four vertical boards 20** would require precision alignment of over ninety-two thousand pairs of pin and socket contacts. Attempts to interconnect the circuit boards without precise alignment could damage thousands of pin contacts.

The alignment difficulties are overcome by supporting connectors 42 and **42*v* for limited movement with respect to their associated separators 36. The distance between each pair of adjacent legs 40 of each separator 36 is slightly greater than the width of each connector 42. Further, the connection of each retaining cap 44 against its associated leg 40 forms two slots, each for one of ears 58. Consequently, while connectors 42 are retained between their adjacent legs 40, each connector has limited movement with respect to its separator 36. Connectors 42v** are similarly supported in their associated separators.

Figure 5:
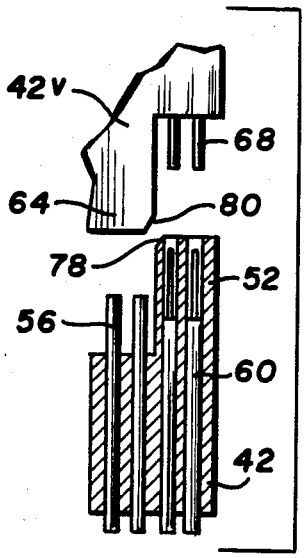
FIG. 5 is a sectional view taken along the lines 5—5 in FIG. 4, and a partial schematic view of an opposed connector.

Along with their limited freedom of movement, connectors 42 and 42v are self-aligning to ensure that opposed pairs of pin contacts and socket contacts are properly aligned well before they contact one another. First, as seen in FIG. 5, first shoulder 52 extends well beyond socket contacts 56, while first shoulder 64 of connector 42v similarly extends beyond socket contacts 68. Further, chamfered edges 78 run along the diverging sides of shoulders 52 and 54 next to the shoulder surfaces. Similarly, shoulders 64 and 66 have chamfered edges 80. Chamfered edges 78 and 80 are inclined approximately 30° from the longitudinal direction. As the shoulders of connectors 42 and 42v approach one another longitudinally, opposed chamfered edges 78 and 80 engage one another and tend to move their respective shoulders transversely into alignment for their nesting engagement as the connectors move longitudinally towards each other. Thus each opposed pair of connectors 42 and 42v is self-aligning, independently of the associated pair of horizontal and vertical circuit boards 18 and 20.

FIG. 6 shows one of a plurality of flat head screws 82 used to mount separator 36 against circuit board 18. Each of wires 73 includes a 90° bend, and extends downwardly to a connection into circuit board 18. A spring metal ground connection 84 is fastened to separator 36 by screws 82, and runs substantially the length of the separator. A portion of ground connection 84 extends outwardly beneath and against legs 40 and connectors 42, and is used in connection with the back plane grid to provide a ground for selected circuits as is later explained. Also seen in FIG. 6 is a relatively steep bevel 86 provided at the outer end of each chamfered edge 78. Bevels 86 provide an initial aligning between connector 42 and grid 88 when circuit board 18 is inserted into position, before any of circuit boards 20 are in position. Similar bevels 87 are at the ends of chamfered edges 80.

Figure 7:
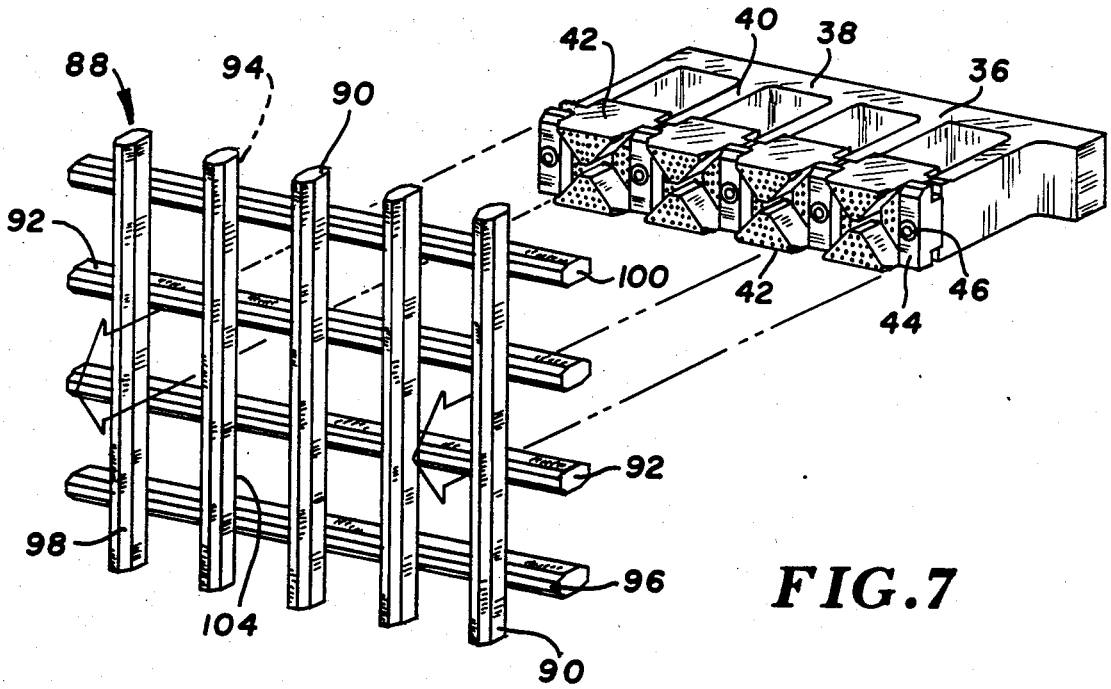
FIG. 7 is a perspective view of a row of connectors from FIG. 3, and a back plane grid constructed in accordance with the present invention.

FIG. 7 shows part of a row of connectors 42 supported in a portion of separator 36 and facing a back plane grid 88, preferably machined from a single piece of aluminum for optimal grounding capability. Only part of grid 88 is shown, and outer frame portion 22 has been removed to enhance illustration of the grid. In use, the grid is positioned between the opposed stacks of vertical and horizontal circuits boards, with vertical rows of contacts 42v facing grid 88 from the opposite side.

Grid 88 is made up of a plurality of electrically conductive vertical support members 90 and a plurality of opposed electrically conductive horizontal support members 92. Substantially planar inside surfaces 94 and 96 of support members 90 and 92, respectively, are connected at various intersections, and together define a vertical interface plane 102 (FIG. 8) crossed by the shoulders of the connectors as they interlock. Adjacent support members form a series of grid openings 104.

Each of vertical support members 90 has a tapered outside surface 98 opposite tapered inside surface 94, and horizontal support members 92 similarly have tapered outside surfaces 100 opposite tapered inside surfaces 96. These tapered surfaces provide an initial, approximate alignment of connectors 42 with backplane grid 88 and connectors 42v as the horizontal and vertical circuit boards move longitudinally toward each other.

Figure 8:
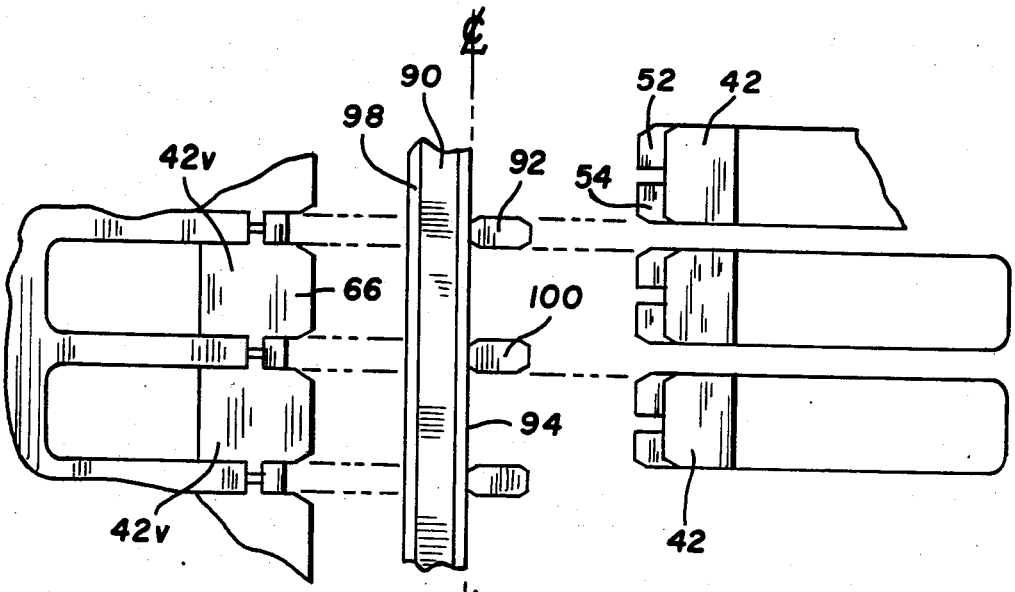
FIGS. 8–10 are schematic side elevations illustrating joinder of opposed connectors through the back plane grid.
Figure 9:
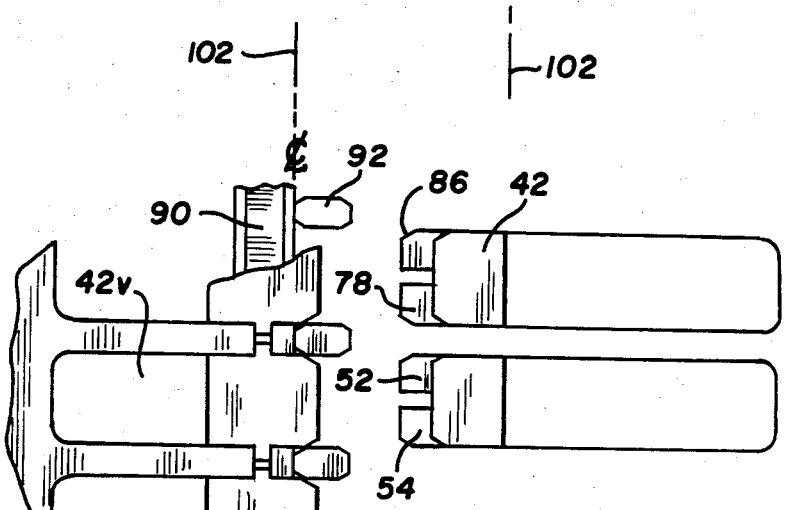
Figure 10:
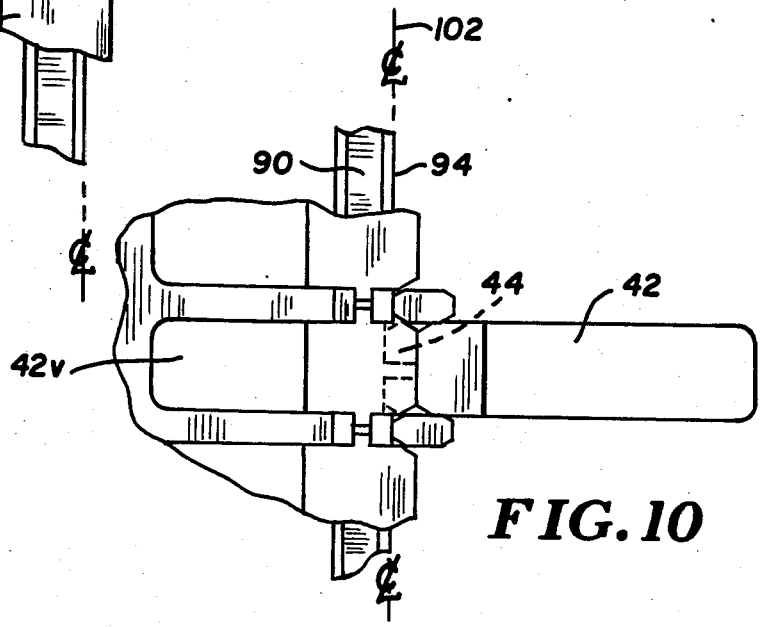

The alignment of opposed pairs of contacts 42 and 42v is best understood from viewing FIGS. 8–10. As horizontal rows of connectors 42 are moved toward back plane grid 88, they first encounter tapered surfaces 100 of horizontal support members 92. Hence each horizontal row is guided to a position between its adjacent horizontal support members. Similarly, each vertical row of connectors 42v is guided between its adjacent pair of vertical support members 90 by virtue of tapered surfaces 98. Further, the horizontal rows of connectors 42 are moved horizontally, and the vertical rows of connectors 42v moved vertically, in order to align each of the connectors with one of grid openings 104.

In FIG. 9, portions of shoulders 64 and 66 of connector 42v have crossed interface plane 102 but have not yet encountered shoulders 52 and 54 of opposed connector 42. In practice, either of connectors 42 or 42v may be the first to cross the interface plane, or they may cross it simultaneously. In any event, when the shoulders of the opposed connectors encounter grid 88, there is an initial alignment effected by bevels 86 and 87 between the support members, and a subsequent, more precise alignment due to chamfered edges 78 and 80 as the connectors engage one another. It is only after this second, precise alignment that further movement of connectors 42v and 42 toward each other brings their respective pin and socket contacts into electrical engagement.

The interlocking engagement is complete when the shoulder surfaces of each connector have been advanced beyond interface plane 102 and are contiguous with the recessed surface of the opposed connector, as shown in FIG. 10. Retaining caps 44 of the horizontal stack abut inside surfaces 94, while the vertical row caps contact inside surfaces 96. The nesting relation of opposed shoulders assures proper alignment of the electrical contacts, and also bears the forces of the circuit board interconnection, preventing these forces from acting upon the electrical contacts. The interlock also positions ground connections 84 against support members 90 and 92, enabling grid 88 to function as ground for the interlocked connector contacts, if desired.

Figure 1:
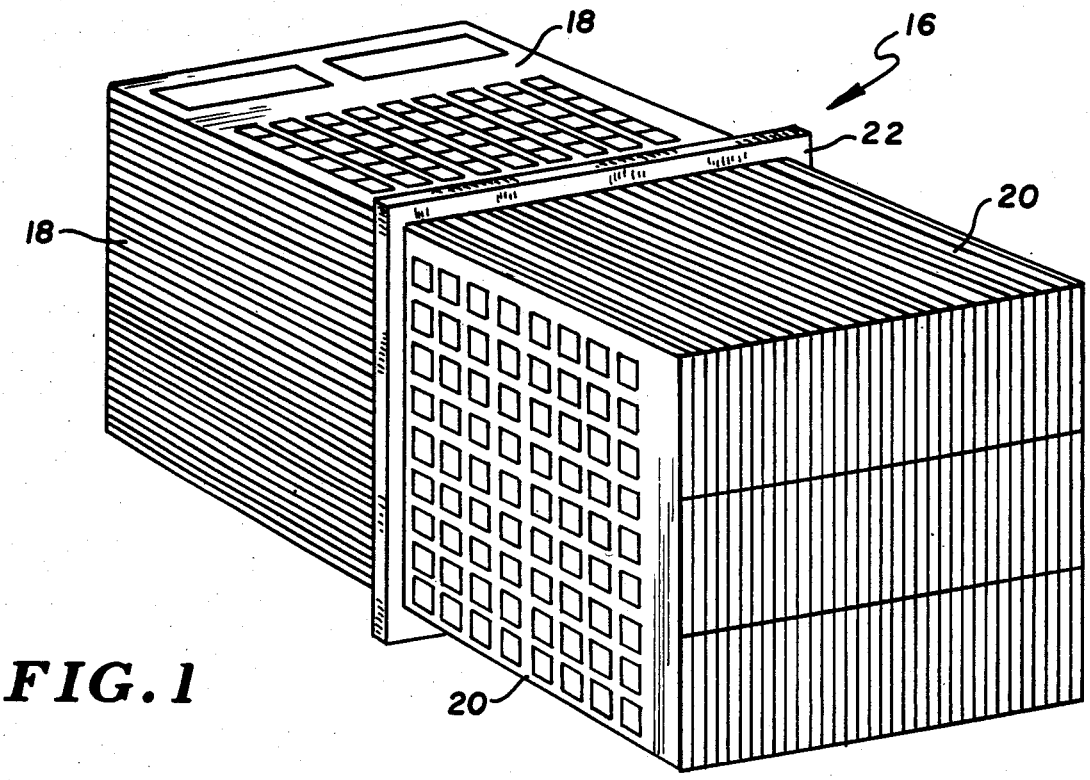
FIG. 1 is a perspective view of an assembly of interconnected circuit boards in accordance with the present invention.

In order to form an assembly such as that shown in FIG. 1, a separator 36 is mounted along the interface edge of each of a stack of circuit boards 18. Then, with a row of connectors 42 positioned between legs 40, retaining caps 44 are fastened to the legs. Each connector 42 is retained in the preferred orientation with respect to its associated one of horizontal circuit boards 18, with limited freedom of movement. Similarly, a second plurality of substantially identical connectors 42v, are mounted along interfacing edges of vertical circuit boards 20, by separators 36, and in the same selected orientation for each connector relative to its associated board.

The vertical and horizontal circuit board stacks are then aligned, with the interfacing edges of the respective circuit boards facing each other, with each of connectors 42 opposed to one of connectors 42v, and with grid 88 between the horizontal and vertical stacks. Finally, the stacks of horizontal and vertical circuit boards are moved towards each other, thus to move each pair of opposed connectors into an interlocking engagement.

The circuit board assembly is easily modified, in that individual horizontal circuit boards 18 can be removed and replaced with other horizontal boards, and horizontal and vertical circuit boards can be interchanged directly, without reorienting or replacing connectors. With identical connectors and connector orientations used in horizontal circuit boards 18 and vertical circuit boards 20, there is virtually no chance for error in preparing these boards for interconnection.

The grid initially aligns opposed connectors, structurally maintains them once interlocked, and serves as the ground for selected circuits. The alignment capability of the grid is augmented by the interaction of the steep bevels and chamfered surfaces, providing for a positive alignment of connector pairs independent of their associated circuit boards.

What is claimed is:

1. A device for making multiple electrical connections, including:

complementary first and second connectors, each connector including an electrically insulative connector body, a plurality of spaced apart electrical first contacts mounted in said connector body and extended away from a substantially planar side surface of the body, a plurality of electrically insulative shoulders projected away therefrom beyond the free ends of said first contacts, and a plurality of spaced apart electric complementary contacts recessed into said shoulders and open to substantially planar, outwardly facing shoulder surfaces of said shoulders, the plane of each shoulder surface being parallel to the plane of said side surface;

said shoulder surfaces of each connector diverging linearly and transversely away from a central portion of said body, to form an interfacing surface consisting of said shoulder surfaces alternating with sectors of said side surface;

said first and second connectors adapted for interlocking mechanical and electrical engagement with each shoulder of each connector in a nesting relation between a pair of neighboring shoulders of the other connector, with the shoulder surfaces of each connector facing the body of the other connector, and with the first contacts of each connector engaged with the complementary contacts of the other connector;

a support means between said first and second connectors for at least approximately aligning said complementary connectors prior to their engaging one another; and a plurality of inclined edge surfaces formed in each shoulder, including chamfered edges running along the diverging sides of each shoulder surface, and a relatively steep bevel at the outward end of each chamfered edge, said bevels engaging said support means to at least approximately align said connectors, whereby each of said adjacent pairs of shoulders, during longitudinal movement of said connectors toward said locking engagement, capture their associated shoulder with said associated shoulder at least approximately aligned for said nesting relation, and guide said associated shoulder transversely into alignment for said nesting relation responsive to said longitudinal movement.

2. The device of claim 1 wherein:

the shoulder surfaces of each of said connectors lie substantially in the same plane.

3. The device of claim 2 wherein:

the shoulder surfaces of each connector are contiguous with the side surface of the other connector when said first and second connectors are in said interlocking engagement.

4. The device of claim 1 wherein:

each of said connectors has two opposite shoulders, and its interfacing surface is comprised of the two associated shoulder surfaces and two opposite sectors of the associated side surface, said shoulder surfaces and sectors each spanning an arc of 90°.

5. An assembly of mechanically and electrically interconnected circuit boards, including:

a first row of substantially parallel and aligned first circuit boards;

a first plurality of substantially identical connectors supported along an interface edge of each first circuit board, each connector in a select orientation with respect to its associated first circuit board;

a second row of substantially parallel and aligned second circuit boards; and a second plurality of connectors, each substantially identical to the connectors of said first plurality, supported along an interface edge of each second circuit board, each connector of said second plurality in a select orientation with respect to its associated second circuit board;

wherein each of the connectors along the interfacing edge of each first circuit board is in an interlocking engagement with one of the connectors associated with each of said second circuit boards, to maintain said first and second rows in an edge facing relation to one another.

6. The assembly of claim 5 wherein:

said first and second rows further are maintained in a selected angularly offset relation to one another.

7. The assembly of claim 5 including:

a plurality of elongate separator members, one for supporting said first and second pluralities of connectors with respect to each of said first and second circuit boards; each separator including an elongate base running along its associated interfacing edge, and a plurality of orthogonal legs extended away from the associated circuit board, with one of said connectors being supported between each pair of adjacent legs.

8. The assembly of claim 7 wherein:

the distance between adjacent legs is greater than the connector width, to permit limited movement of each connector with respect to its associated separator member.

9. The assembly of claim 8 including:

a retaining cap removably attached to the free end of each of said legs, for retaining each of said connectors with respect to its associated pair of legs.

10. The assembly of claim 9 further including:

a support means between said first and second rows of circuit boards, for forming an interface plane between said rows, with said caps of said first row in contact with said support means on one side of said plane, and the caps of said second row contacting said support means along the other side of said plane.

11. The assembly of claim 10 wherein:

said support means comprises a grid having a plurality of elongate spaced apart first support members perpendicular to the circuit boards in said first row, and a plurality of elongate spaced apart second support members orthogonal to the circuit boards in said second row, said first and second support members connected to each other at intersections of inside surfaces thereof, the inside surfaces of said support members defining said support plane.

12. The assembly of claim 11 wherein:

each of said support members has a tapered outside surface, and said tapered surfaces cooperate to guide opposed ones of said connectors towards alignment with one another as said opposed connectors are moved toward said interlocking engagement.

13. The assembly of claim 11 wherein:

each of said support members has a tapered surface on each side of said inside surface, and said tapered surfaces cooperate to guide opposed ones of said connectors towards alignment with one another as said opposed connectors are moved toward said interlocking engagement.

14. The assembly of claim 10 wherein:

said support means is electrically conductive and serves as the ground for at least a portion of the electrical circuits that include said connectors.

15. The assembly of claim 9 further including:

at least one pair of opposed ears extended from each of said connectors, the retaining caps and legs associated with each connector forming an opposed pair of slots, each slot retaining one of said ears.

16. The assembly of claim 5 wherein:

each connector includes a plurality of spaced apart first electrical contacts projected therefrom, a plurality of spaced apart shoulders projected therefrom beyond the free ends of said first contacts, and a plurality of complementary electrical contacts recessed into said shoulders and open to outwardly facing shoulder surfaces of the shoulders;

each shoulder of each connector being adapted for a nesting relation between a pair of adjacent shoulders of an opposed one of said connectors.

17. The assembly of claim 16 wherein:

the shoulder surfaces of each connector diverge linearly away from the connector center to form an interfacing surface consisting of said shoulder surfaces, alternating with sectors of a side surface from which said shoulders project.

18. The assembly of claim 17 wherein:

each of said connectors includes two opposite shoulders, and its interfacing surface is comprised of the two associated shoulder surfaces and two opposite sectors of the side surface, each of said shoulder surfaces and sectors spanning an arc of 90°.

19. The apparatus of claim 17 including:

chamfered edge portions along the linearly diverging edges of each shoulder surface, for aligning each shoulder with its associated adjacent shoulders in said opposed connector as said contacts are moved into said interlocking engagement.

20. The assembly of claim 19 further including:

relatively steeply inclined bevels at the outer ends of said chamfered edge portions.

21. A process for connecting first and second rows of circuit boards orthogonally with respect to one another, including the steps of:

(a) mounting a first plurality of substantially identical connectors along an interface edge of each of said first circuit boards, with each of said connectors in a select orientation with respect to its associated one of said first circuit boards;

(b) mounting a second plurality of connectors, each substantially identical to the connectors of said first plurality, along an interfacing edge of each of a plurality of second circuit boards, with each connector of said second plurality in a select orientation with respect to its associated one of said second circuit boards;

(c) aligning said first and second rows of circuit boards orthogonally with respect to one another, with the interfacing edges of said first and second circuit boards facing each other, and with each of said connectors supported with respect to each of said first circuit boards opposed to an associated one of the connectors supported with respect to said second circuit boards; and (d) moving said first and second rows of circuit boards towards each other, to move each connector and its opposed, associated connector into an interlocking engagement.

22. The process of claim 21 including the further step of:

(a) interposing a grid between said first and second rows of circuit boards prior to moving them towards each other, and with the openings in said grid aligned between pairs of associated connectors.

* * * * *